US009969185B1

(12) United States Patent
Condello et al.

(10) Patent No.: US 9,969,185 B1
(45) Date of Patent: May 15, 2018

(54) PRETREATMENT OF UV CURED INK UNDER-LAYERS

(71) Applicant: XEROX CORPORATION, Norwalk, CT (US)

(72) Inventors: Anthony S. Condello, Webster, NY (US); Jack T. LeStrange, Macedon, NY (US)

(73) Assignee: XEROX CORPORATION, Norwalk, CT (US)

( * ) Notice: Subject to any disclaimer, the term of this patent is extended or adjusted under 35 U.S.C. 154(b) by 69 days.

(21) Appl. No.: 15/435,184

(22) Filed: Feb. 16, 2017

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 11/00; B41J 2/2114; B41J 2/0057; B41J 2002/012; B41J 2/01; B41M 1/34
See application file for complete search history.

(56) References Cited

U.S. PATENT DOCUMENTS 6,467,871 B1 * 10/2002 Moffat ..... B41J 2/14 347/21
8,520,040 B2 * 8/2013 Kaechi ..... B41J 2/325 347/215
9,303,185 B2 * 4/2016 Sambhy ..... B41J 2/01

* cited by examiner

*Primary Examiner* — Kristal Feggins
(74) *Attorney, Agent, or Firm* — MH2 Technology Law Group LLP

(57) ABSTRACT

Provided is a printing method, including: depositing a first curable material on a substrate; at least partially curing the first curable material to form an under-layer, wherein the under-layer has a first surface energy; modifying the under-layer's surface energy from the first surface energy to a second surface energy; and depositing a second curable material on the under-layer.

20 Claims, 5 Drawing Sheets

PRETREATMENT OF UV CURED INK UNDER-LAYERS

TECHNICAL FIELD

Embodiments described herein relate generally to printing to aqueous inkjet printers, and, in particular, to surface preparation for aqueous ink inkjet printing, including methods to treat under-layers to ensure good wetting of the primary image on different substrates.

BACKGROUND

It is desirable to print images on various substrates, including in packaging applications. In such applications, the desired image may be formed via ink jet printing. In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. Because the spread of the ink droplets striking the media is a function of the media surface properties and porosity, print quality will be inconsistent. To address this issue, either properties of the ink must be modified or properties of the media on which the inks are printed must be modified. For example, adding surfactants to the ink reduces the surface tension of the ink, but such solutions present additional problems including uncontrolled spreading of the ink. This can result in the edges of single pixel lines to be undesirably wavy. Moreover, aqueous printheads have certain minimum surface tension requirements (i.e., greater than 20 mN/m) that must be met for good jetting performance. Alternatively, protective base-layers can be formed on the media by ejecting curable inks onto the media surface and then curing the curable inks, for example, via ultraviolet radiation for UV curable inks. The subsequently printed ink droplets may then be printed on the base-layers in a manner that avoids the changes in image quality resulting from the media properties, such as those that occur in response to media contact with the water or solvents in aqueous ink and affect ink drop spread.

As such, the base formed by the cured inks are typically referred to as the image "under-layer" which may comprise one or more layers of white, transparent or colorful inks. Use of these under-layers can be particularly important when printing onto plastics, especially those that are clear or translucent. While the base is necessary in order to achieve desired final image color and overall product appearance to avoid ink-media interactions, one issue that arises with printing onto a UV Ink base or under-layer is the inability of the subsequently color printed image to adequately wet it. Such under layers may also be susceptible to other issues. For example, if the under layer is under-cured, it may offset to any other surface that it comes into contact with (e.g., rollers used in the printer to transport the media). It is also possible that in an under cured state the subsequently printed color ink drops may be enveloped, encapsulated or otherwise distorted by the soft under-cured under-layer(s). Likewise, over-curing of the base ink under-layer may also lead to unacceptable results, such as insufficient wetting of the subsequently printed image color layers.

While optimization of curing parameters could be relied on to address these problems, other problems arise. For example, depending on the image being formed, the curing parameters for optimal curing of the base layer may be different from image to image, may vary depending on the different media being printed on or image forming inks being deposited thereon, or may simply not be attainable and risks offsetting as described above when the underlayer(s) contact a surface of the printer. Therefore, optimization of curing parameters to cure the UV inks that form the base under-layers is not feasible.

Surfaces that provide for improved image formation without adding to the issues of curing the base layer(s) are desirable. Therefore, there is a need for an approach for controlling UV-curable ink surface properties and subsequently printed ink-spread of a printed image during a printing process.

SUMMARY

In an embodiment, there is a printing method, comprising: depositing a first curable material on a substrate; at least partially curing the first curable material to form an under-layer, wherein the under-layer comprises a first surface energy; modifying the under-layer's surface energy from the first surface energy to a second surface energy; and depositing a second curable material on the under-layer.

In another embodiment there is a printing apparatus, comprising: a substrate handling and transport system; at least one jetting nozzle of a first printhead positioned proximate the substrate handling and transport system, and configured for jetting first curable material droplets image-wise onto a substrate; at least one under-layer curing station for curing the first curable material to form an under-layer on the substrate; at least one under-layer surface-modification station for modifying the under-layer's surface energy from a first surface energy to a second surface energy; and at least one jetting nozzle of a second printhead positioned proximate the substrate handling and transport system, and configured for jetting second curable material droplets image-wise onto the under-layer.

Advantages can include one or more of the following: low sensitivity to cure tolerances/conditions; increased under-layer surface wettability; and reduction or elimination of offset issues.

Additional advantages of the embodiments will be set forth in part in the description which follows, and in part will be understood from the description, or may be learned by practice of the embodiments. The advantages will be realized and attained by means of the elements and combinations particularly pointed out in the appended claims.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this specification, illustrate embodiments of the present teachings and together with the description, serve to explain the principles of the disclosure.

DETAILED DESCRIPTION

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The following embodiments are described for illustrative purposes only with reference to the Figures. Those of skill in the art will appreciate that the following description is exemplary in nature, and that various modifications to the parameters set forth herein could be made without departing from the scope of the present embodiments. It is intended that the specification and examples be considered as examples only. The various embodiments are not necessarily mutually exclusive, as some embodiments can be combined with one or more other embodiments to form new embodiments.

As used herein, unless otherwise specified, the word "printer" encompasses any apparatus that performs a print outputting function for any purpose, such as a digital copier, bookmaking machine, facsimile machine, a multi-function machine, electrostatographic device, inkjet printer, etc.

It will be understood that the structures depicted in the figures may include additional features not depicted for simplicity, while depicted structures may be removed or modified.

Figure 1A:
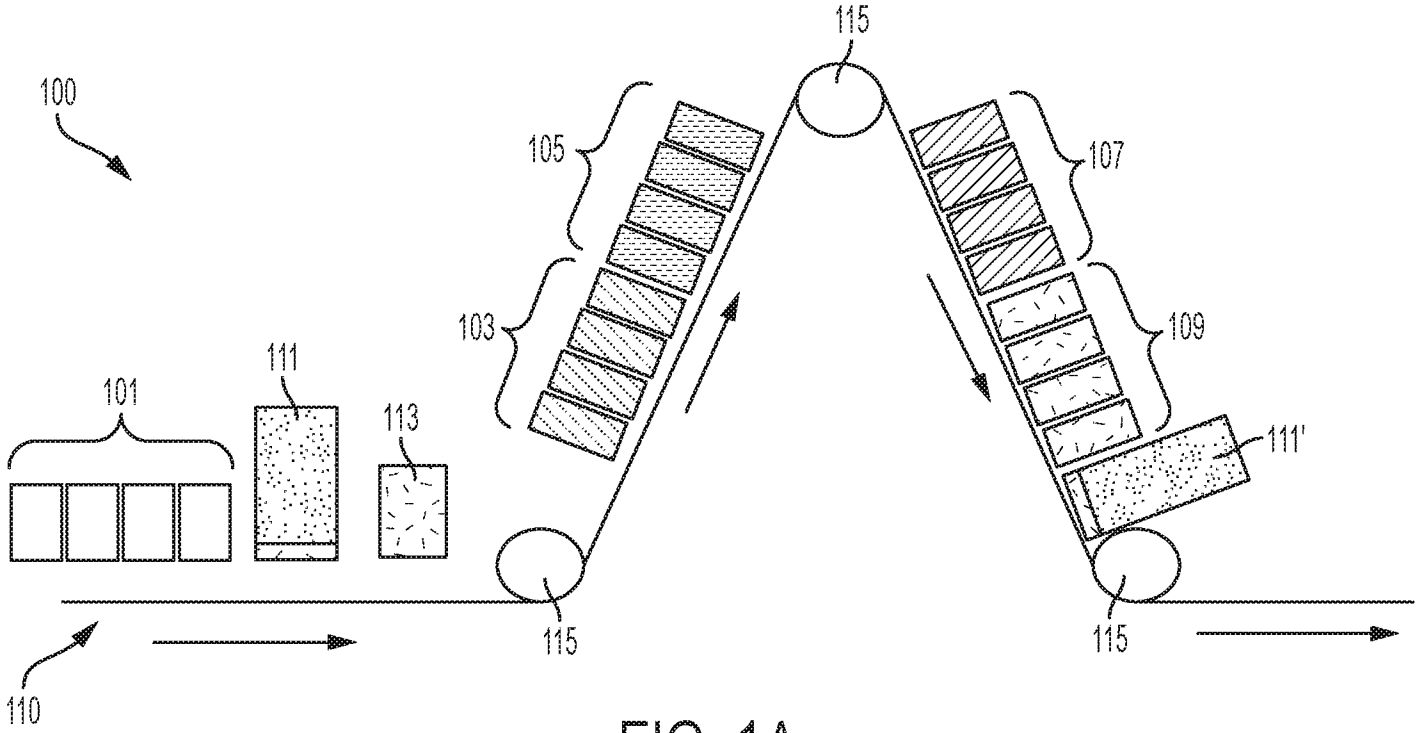
FIG. 1A depicts a printing apparatus according to an embodiment.
Figure 2A:
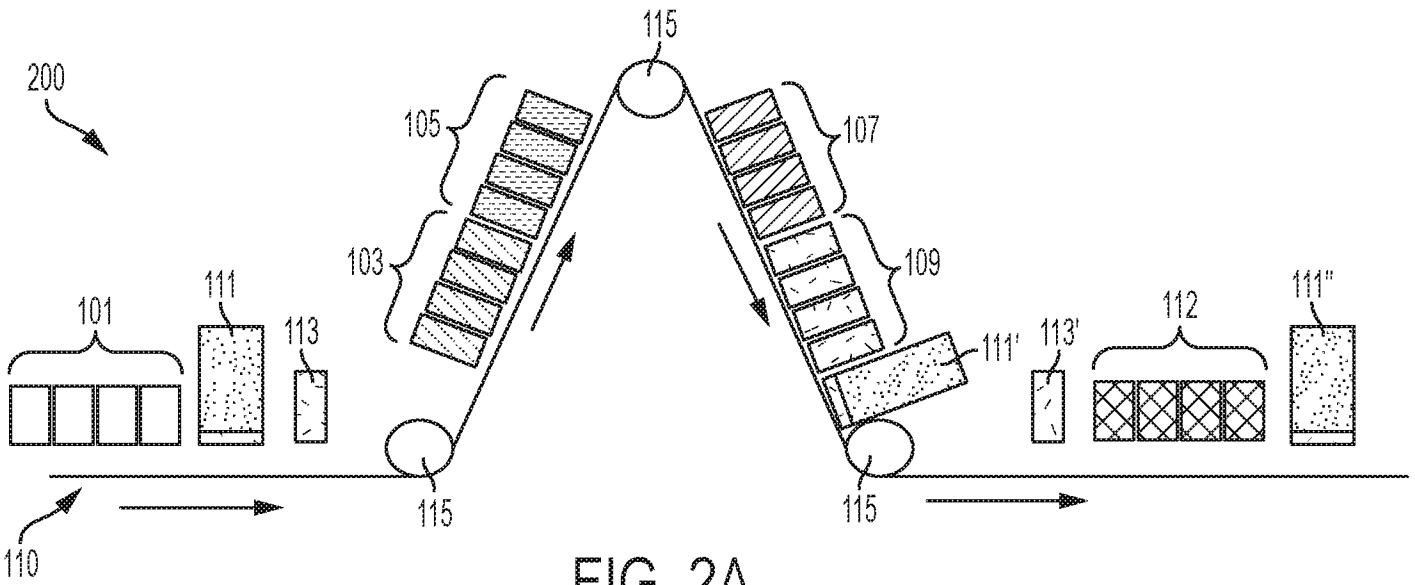
FIG. 2A depicts a printing apparatus according to an embodiment.
Figure 3:
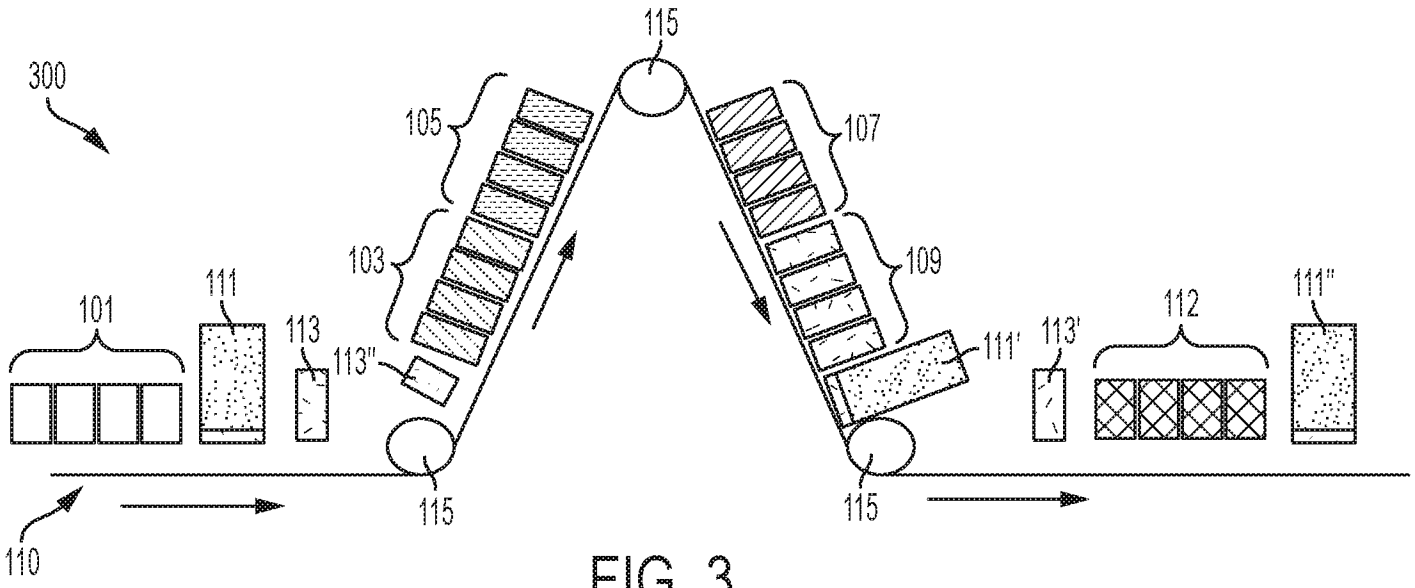
FIG. 3 depicts a printing apparatus according to an embodiment.

FIGS. 1A, 2A and 3 each depict embodiments of image producing machine or printers 100, 200 and 300, respectively, according to the embodiments. The printers 100, 200 and 300 are printing apparatus that may be used to form an ink image on an image accepting media including such substrates as, but not limited to, sheets of paper, cardboard, plastic, or other porous media. For example, a substrate 110 is manipulated by a substrate handling and transport system 115 along the printing path indicated by the arrows. Meanwhile, jetting nozzles from at least one first printhead 101, the at least one second printheads 103, 105, 107 and/or 109, and/or third printheads 112, and disposed proximate the substrate handling and transport system, are configured for depositing material (e.g., via inkjet jetting) imagewise over a surface of the substrate in order to form an image thereon.

In embodiments, the printheads 101, 103, 105, 107, 109, and 112 may extend across the width of the substrate. These printheads can, therefore, be included in printhead modules that include a single printhead or a plurality of printheads, for example, a plurality of printheads configured in a staggered arrangement for delivery of the curable material droplets that are subsequently modified and formed into an under-layer, a color layer and/or an overcoat layer.

The printhead modules can be operatively connected to the printer's frame (not shown) and aligned to eject the curable materials in an imagewise pattern on the surface of the substrate. The associated printhead modules for the printhead 101, 103, 105, 107, 109 and/or 112 can include corresponding electronics, reservoirs, and conduits to supply ink compositions (e.g., UV-curable ink compositions) to the one or more printheads. For example, conduits (not shown) can operatively connect a source to the at least one printhead to provide a supply of ink to the one or more printheads. Each of the printheads 101, 103, 105, 107, 109 and/or 112 can be the same kind of printhead used for depositing ink, such as inkjet printheads. The printhead for jetting the curable materials can be a conventional printhead such as Kyocera KJ4B series which is designed for jetting water based inks, although the embodiments are not so limited.

At various stations along the printing path, the chemical and/or physical properties of the deposited materials may be manipulated. For example, curing stations 111, 111' and 111" can provide ultraviolet radiation to the deposited materials. In the case in which the deposited material comprises UV-curable material, the ultraviolet radiation causes the UV-curable material to at least partially cure and form a layer having an initial surface energy. The low energy surface of the cured layer formed by curing the deposited ink does not aid in the formation of good quality ink images because such surfaces do not spread ink drops as well as high energy surfaces. Meanwhile, the handling and transport system 115 may include a plurality of rollers that come in contact with a top surface or bottom surface of the substrate 110, including in contact with the layer formed thereon. In some circumstances, the formed layer may be susceptible to under-cure or over-cure which can lead to offsetting, or wettability issues for the subsequently deposited material. To address this issue, modifying the layer's surface energy, for example, from the initial surface energy to a subsequent surface energy can result in more precise imagewise patterns for subsequently deposited materials. Consequently, a surface modification unit 113, 113', and/or 113' can be used for modifying the surface of the substrate via, for example, flame treatment, corona discharge or plasma.

Figure 1B:
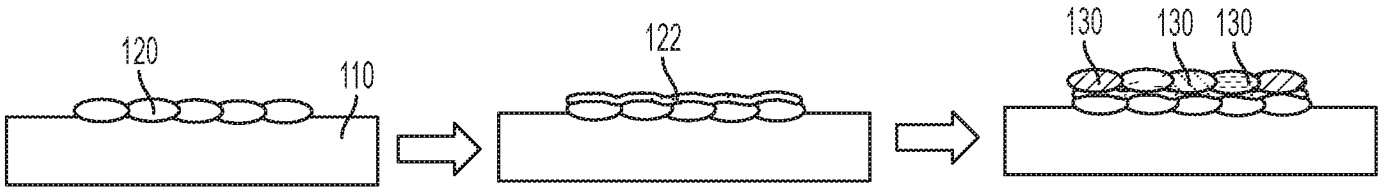
FIG. 1B depicts various stages of a printing method according to an embodiment, for example, as executed by the printing apparatus of FIG. 1A.
Figure 2B:
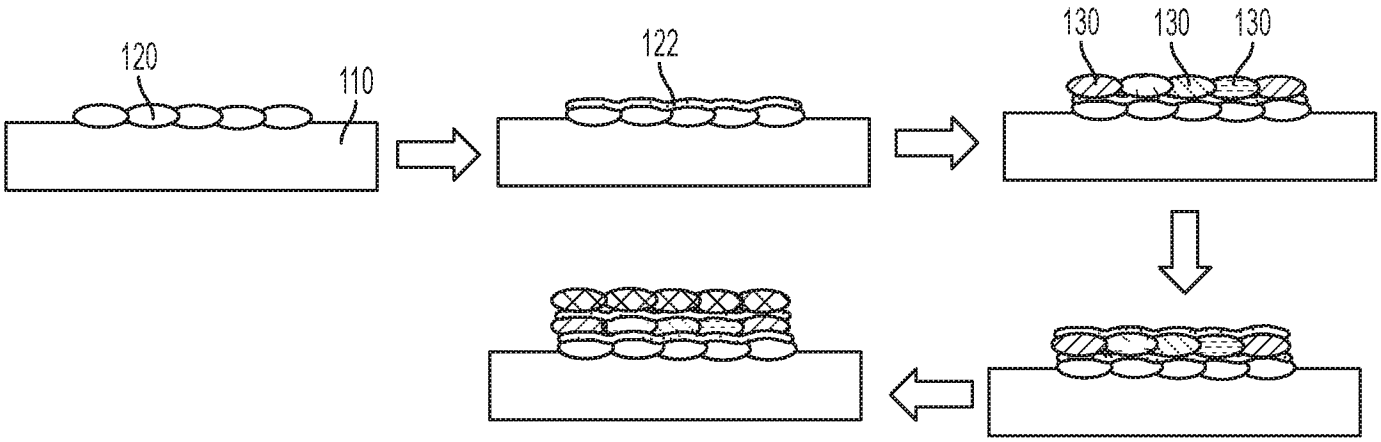
FIG. 2B depicts various stages of a printing method according to an embodiment, for example, as executed by the printing apparatus of FIG. 2A.

A print cycle, as implemented by, for example, printer 100, 200 and/or 300, is now described with reference to FIGS. 1B and 2B. As used in this document, "print cycle" refers to the completion of steps of a printing method to implement operations of a printer to prepare an imaging surface for printing, ejection of the ink(s) (e.g., a UV-curable ink(s)) onto the prepared surface, for example, to form at least one under-layer and/or additional color layer(s) or overcoat layer(s), and treatment of the ink(s) on the imaging surface to stabilize and prepare the image for overlaying with additional ink layers.

The printer 100, 200 and 300 each may include a frame such as an A-frame that supports, directly or indirectly, operating subsystems and components. As described above, the printer 100, 200 and 300 includes a substrate handling and transport system 115 which can be configured to include a supported endless belt on which a substrate travels. The printer 100, 200 and 300 can be configured to perform a printing method that includes depositing a first curable material 120 on the substrate 110. In the printing method of at least an embodiment, the first curable material can be deposited dropwise, for example, via jetting from a nozzle associated with printhead 101, and in an imagewise pattern. The deposited sacrificial coating can have any desired thickness.

The deposited first curable material 120 may then be at least partially cured at the first curing station 111 such that the first curable material 120 forms one or more of an under-layer. At this point, however, the at least partially cured under-layer comprises a first surface energy that is not conducive to desirable wetting of subsequently deposited inks. Accordingly, the method continues with modifying the under-layer's surface energy from the first surface energy to a second surface energy. The under-layer surface modification unit 113 provides at least one of a flame source, corona source or plasma source to an exposed surface of the substrate 110. The resulting modified surface 122 of the under-layer is then ready for accepting subsequently deposited inks. Accordingly, the modifying of the under-layer's surface energy may be performed before the depositing of the second curable material. It is noted that an additional under-layer surface modification unit 113" may be included in, for example, a printer 300 between the under-layer surface modification unit 113 and the printhead 103. Such an additional under-layer surface modification unit 113" may be used for removing impurities from the substrate surface.

The printing methods of the embodiments can include depositing a second curable material 130 on the under-layer. For example, at least one jetting nozzle of a second printhead positioned proximate the substrate handling and transport system, and configured for jetting the second curable material droplets imagewise onto the under-layer. In an embodiment, one or more of printheads 103, 105, 107, and/or 109 may be used for depositing second curable material(s) such as cyan, magenta, yellow and/or blank curable inks on the modified surface 122 of the under-layer. The second curable materials may then be cured by curing station 111' to form a color layer 130 having an initial surface energy (i.e., a third surface energy).

It may be desirable to protect the color-layer, for example, via an overcoat layer. Accordingly, in an embodiment, printers 200 and 300 each include at least one jetting nozzle of a third printhead 112 positioned proximate the substrate handling and transport system, and configured for jetting third curable material droplets imagewise onto the substrate. However, the color-layer may not have appropriate initial surface energy to allow for proper wetting of the overcoat layer-forming ink(s) (i.e., the third curable material). Therefore, at least one color-layer surface-modification unit 113' may be included for modifying the color-layer's surface energy from the third surface energy to a fourth surface energy. In an embodiment, the at least one color-layer surface-modification unit provides at least one of a flame, a corona, a plasma, or combinations thereof to the color-layer surface.

The resulting modified surface 132 of the color layer is then ready for accepting subsequently deposited inks, such as those comprising the third curable material. Additionally, an overcoat layer curing station 111" may be provided in printer 200 and printer 300 in order to cure the third curable material and to form the overcoat layer on the color layer 140.

In an embodiment, the first curable material comprises an ultraviolet (UV) curable ink, for example a white UV-curable ink. In an embodiment, the second curable material comprises an UV curable ink comprising, for example, UV curable ink comprises a black colorant, a magenta colorant, a cyan colorant, a yellow colorant or combinations thereof. In an embodiment, the second curable material comprises a transparent UV curable ink, UV-Curable Materials As described above, the at least one under-layer, the color layer, and/or the overcoat layer may be separately formed by curing a curable material. In an embodiment, the curable material may be cured by exposure to ultraviolet radiation (i.e., a UV-curable material). For example, the UV-curable material may comprise an ultraviolet-curable aqueous ink. In an embodiment, the ultraviolet-curable aqueous ink may comprise an ultraviolet polymerizable compound. The ultraviolet polymerizable compound may be exemplified with a compound having a polymerizable group that is radically polymerized by UV rays, and may be a monomer, an oligomer, or a mixture thereof. As the polymerizable group, a group having an ethylenically unsaturated double bond may be exemplified, and specific examples thereof may include an acryloyl group, a methacryloyl group, a vinyl group, a vinyl ether group, a maleic anhydride group, and an N-substituted maleimide group. The ultraviolet polymerizable compound may be used either alone or in combination of two or more kinds thereof.

The ultraviolet polymerizable compound may be a water-soluble ultraviolet polymerizable compound or a water-insoluble ultraviolet polymerizable compound. In an example of the ultraviolet polymerizable compound, "water-soluble" means that an object material is dissolved in an amount of 5 parts by mass or more (preferably, 10 parts by mass or more) based on 100 parts by mass of water at 25° C. In an example of the ultraviolet polymerizable compound, "water-insoluble" means that an object material is dissolved in an amount of less than 5 parts by mass based on 100 parts by mass of water at 25° C.

The ultraviolet polymerizable compound may comprise a water-soluble ultraviolet polymerizable compound. The water-soluble ultraviolet polymerizable compound may comprise a conventionally known UV polymerizable compound. In an embodiment, the water-soluble ultraviolet polymerizable compound may include radical polymerizable monomers such as acryloyl morpholine (ACMO), hydroxyethyl acrylamide (HEAA), diacetone acrylamide, N-vinyl-2-pyrrolidone, N-vinyl-formamide, vinyl naphthalene sulfonic acid, hydroxyethyl(meth)acrylate, methoxypolyethylene glycolmethacrylate, methoxy polyethylene glycolacrylate, ester of succinic anhydride and 2-hydroxyethyl(meth)acrylate, ester of orthophthalic anhydride and 2-hydroxyethyl(meth)acrylate, and combinations thereof. In an embodiment, the water-soluble ultraviolet polymerizable compound may include a water-soluble ultraviolet polymerizable monomer such as (meth)acrylate ester of polyhydric alcohol, and (meth)acrylate ester of glycidyl ether derived from polyhydric alcohol.

As the water-insoluble ultraviolet polymerizable compound, a conventionally known water-insoluble ultraviolet polymerizable substance may be exemplified, and specific examples of the water-insoluble ultraviolet polymerizable substance may include radical polymerizable monomers such as alcohols, acrylate esters of polyhydric alcohols or amino alcohols; methacrylate esters of alcohols or polyhydric alcohols; acrylic aliphatic amides; acrylic alicyclic amides; and acrylic aromatic amides.

The ultraviolet polymerizable compound may comprise a water-soluble ultraviolet polymerizable compound. The water-insoluble ultraviolet polymerizable compound may comprise oligomers obtained by polymerizing water-insoluble ultraviolet polymerizable monomers to a required degree of polymerization. For example, the water-insoluble ultraviolet polymerizable compound may comprise oligomers of acrylate (e.g., epoxy acrylate, urethane acrylate, polyester acrylate, polyether acrylate, urethane methacrylate, and polyester methacrylate) having an acryloyl group or a methacryloyl group on an epoxy skeleton, an urethane skeleton, a polyester skeleton or a polyether skeleton. In an embodiment, the water-insoluble ultraviolet polymerizable compound is emulsified and dispersed in an aqueous ink by a conventionally known method. The water-insoluble ultraviolet polymerizable material may be a self-emulsified or emulsified by a dispersant.

The ultraviolet-curable aqueous ink may further comprise one or more of a ultraviolet polymerization initiator. For example, the one or more ultraviolet polymerization initiator may include a water-soluble ultraviolet polymerization initiator or a water-insoluble ultraviolet polymerization initiator. In an embodiment, the ultraviolet polymerization initiator may include a water-insoluble thioxanthone compound. Specific examples of the thioxanthone compound may include isopropyl thioxanthone, diethyl thioxanthone, chlorothioxanthone, dimethyl thioxanthone, methylethyl xanthone, and methyl isopropyl xanthone. The ultraviolet polymerization initiator may be used in combination with other ultraviolet polymerization initiators in addition to or other than the thioxanthone compound. For example, the ultraviolet polymerization initiator may comprise one or more water-soluble ultraviolet polymerization initiators including conventionally known ultraviolet polymerization initiators such as hydroxyacetophenones (e.g., 1-phenyl-2-hydroxy-2-methyl-1-propanone, 1-hydroxy-cyclohexyl-phenyl-ketone, 1-[4-(2-hydroxyethoxy)-phenyl]-2-hydroxy-2-methyl-1-propanone), aminoacetophenones (e.g., 2-methyl-1-(4-methylthiophenyl)-2-morpholinopropane-1-one, 2-benzyl-2-dimethyl amino-1-(4-morpholinophenyl)-butane-1-one), thioxanthone ammonium salts, and benzophenone ammonium salts. Examples of other water-insoluble ultraviolet polymerization initiator may include conventionally known ultraviolet polymerization initiators such as a benzoin compound (e.g., benzoin ethylether, benzoin isopropyl ether), benzophenone, an acylphosphine oxide compound (bis(2,4,6-trimethylbenzoyl)-phenylphosphine oxide, bis(2,6-dimethoxybenzoyl)-2,4,4-trimethylpentyl phosphine oxide, 2,4,6-trimethylbenzoylphenyl ethoxyphosphine oxide, 2,4,6-trimethylbenzoyl diphenylphosphine oxide), and an anthraquinone compound (e.g., ethyl anthraquinone). Other water-insoluble ultraviolet polymerization initiator may be emulsified and dispersed in an aqueous ink by a conventionally known method using a dispersant, etc., or may be dissolved or dispersed by a water-soluble organic solvent and dispersed in an ink.

The ultraviolet-curable aqueous ink may further comprise a hydrogen donor agent (i.e., an ultraviolet polymerization auxiliary initiator). As the hydrogen donor agent, a water-insoluble tertiary amine compound may be employed. For example, the water-insoluble tertiary amine compound may include 2-dimethylamino ethyl benzoate, 4-dimethylamino ethyl benzoate, 4-dimethylamino isoamyl benzoate, 4-dimethylamino methyl benzoate, 4-dimethylamino 3-methylbutyl benzoate, 4-dimethylamino 2-ethylhexyl benzoate, p-piperidinyl methyl benzoate, p-piperidinyl ethyl benzoate, p-piperazinyl methyl benzoate, p-piperazinyl ethyl benzoate, p-morpholino methyl benzoate, p-morpholino ethyl benzoate, 4-diethylamino methyl benzoate, 4-diethylamino 3-methylbutyl benzoate, 2-diethylamino ethyl benzoate, 4-diethylamino ethyl benzoate, 4-diethylamino isoamyl benzoate, tripropylamine, tributylamine, dimethylphenyl piperazine, 1-(2-ethoxyphenylpiperazine, and 1-(2,6-dimethoxyphenyl) piperazine and combinations thereof. The hydrogen donor agent (ultraviolet polymerization auxiliary initiator) may be used in combination with other hydrogen donor agents besides the water-insoluble tertiary amine compound. Examples of other hydrogen donor agents may include conventionally known hydrogen donor agents such as amine-containing compounds such as aliphatic amine, amine (piperidine) containing an aromatic group, and triethanolamine; urea-containing compounds such as allylurea, and o-tolylthiourea; sulfur-containing compounds such as sodium diethyldithiophosphate, and a soluble salt of aromatic sulfinic acid; a nitrile-containing compound such as N,N,di-substituted p amino benzonitrile; phosphorous-containing compounds such as tri-n-butylphosphine, sodium diethyl dithiophosphate; nitrogen-containing compounds such as Michler's ketone, N-nitrosohydroxyl amine derivatives, oxazolidine compounds, tetrahydro-1,3-oxazin compounds, and condensates of aldehyde (formaldehyde or acetaldehyde) and diamine; a polymerized amine constituted by a reaction product of an epoxy resin and amine; and triethanolamine triacrylate.

The ultraviolet-curable aqueous ink may further include water. The water may comprise ion-exchanged water, ultrapure water, distilled water, or ultrafiltration water may be appropriately exemplified, especially, from the standpoint of suppressing impurities from being mixed, or microorganisms from being produced.

The ultraviolet-curable aqueous ink may further include a water-soluble organic solvent. Examples of other water-soluble organic solvent may include polyhydric alcohols, polyhydric alcohol derivatives, a nitrogen-containing solvent, alcohols, and a sulfur-containing solvent. Further examples of the water-soluble organic solvent may include propylene carbonate, and ethylene carbonate. Examples of the polyhydric alcohols may include sugar alcohols such as ethylene glycol, diethylene glycol, propylene glycol, butylene glycol, triethylene glycol, 1,5-pentanediol, 1,2-hexanediol, 1,2,6-hexanetriol, glycerin, trimethylolpropane, and xylitol; and saccharides such as xylose, glucose, and galactose. Examples of the polyhydric alcohol derivatives may include ethylene glycol monomethyl ether, ethylene glycol mono ethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adduct of diglycerin. The water-soluble organic solvent may be used either alone or in combination of two or more kinds thereof. The content of the water-soluble organic solvent may preferably range from 1 mass % to 60 mass %, and more preferably from 1 mass % to 40 mass %, based on the water.

The under-layer may be white, transparent or may comprise a color. Accordingly, the UV-curable material may include a coloring agent, for example, a pigment. In an embodiment, the UV-curable material may comprise a black pigment, at least one of a primary color pigments including cyan, magenta, and/or yellow, specific color pigments such as red, green, blue, brown, and white, metallic luster pigments such as gold and silver, colorless pigments, or combinations thereof. Pigment, particles may be obtained by fixing a dye or a pigment onto the surface of silica, alumina, or polymer beads as a core, and/or may include an insoluble lake product of a dye, a colored emulsion, and a colored latex.

Specific examples of a black pigment may include Raven 7000, Raven 5750, Raven 5250, Raven 5000 ULTRAII, Raven 3500, Raven 2000, Raven 1500, Raven 1250, Raven 1200, Raven 1190 ULTRAII, Raven 1170, Raven 1255, Raven 1080, and Raven 1060 (all manufactured by Columbian Carbon Co., Ltd), Regal 400R, Regal 330R, Regal 660R, Mogul L, Black Pearls L, Monarch 700, Monarch 800, Monarch 880, Monarch 900, Monarch 1000, Monarch 1100, Monarch 1300, and Monarch 1400 (all manufactured by Cabot Corporation), Color Black FW1, Color Black FW2, Color Black FW2V, Color Black 18, Color Black FW200, Color Black 5150, Color Black S160, Color Black 5170, Printex35, Printex U, Printex V, Printex 140U, Printex 140V, Special Black 6, Special Black 5, Special Black 4A, and Special Black 4 (all manufactured by DEGUSSA Corporation), and No. 25, No. 33, No. 40, No. 47, No. 52, No. 900, No. 2300, MCF-88, MA600, MA7, MA8, and MA100 (all manufactured by Mitsubishi Chemical Corporation), but the embodiments described herein are not limited thereto. Specific examples of a cyan color pigment may include C.I. Pigment Blue-1, -2, -3, -15, -15:1, -15:2, -15:3, -15:4, -16, -22, and -60, but the embodiments described herein are not limited thereto. Specific examples of a magenta color pigment may include C.I. Pigment Red-5, -7, -12, -48, -48:1, -57, -112, -122, -123, -146, -168, -177, -184, -202, and C.I. Pigment Violet-19, but the embodiments described herein are not limited thereto. Specific examples of a yellow pigment may include C.T. Pigment Yellow-1, -2, -3, -12, -13, -14, -16, -17, -73, -74, -75, -83, -93, -95, -97, -98, -114, -128, -129, -138, -151, -154, and -180, but the embodiments described herein are not limited thereto. In an embodiment, when the pigment is used as the coloring agent, a pigment dispersant is preferably used together with the pigment. Examples of the pigment dispersant that may be used may include a polymer dispersant, an anionic surfactant, a cationic surfactant, an amphoteric surfactant, and a nonionic surfactant.

While the embodiments have been illustrated respect to one or more implementations, alterations and/or modifications can be made to the illustrated examples without departing from the spirit and scope of the appended claims. In addition, while a particular feature of the embodiments may have been disclosed with respect to only one of several implementations, such feature may be combined with one or more other features of the other implementations as may be desired and advantageous for any given or particular function.

Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments will be apparent to those skilled in the art from consideration of the specification and practice of the descriptions disclosed herein. It is intended that the specification and examples be considered as exemplary only, with a true scope and spirit of the embodiments being indicated by the following claims.

What is claimed is:

1. A printing method, comprising:

depositing droplets of a first curable material on a substrate;

at least partially curing the first curable material to form an under-layer, wherein the under-layer comprises a first surface energy;

modifying the under-layer's surface energy from the first surface energy to a second surface energy; and depositing droplets of a second curable material on the under-layer.

2. The printing method of claim 1, wherein the depositing of the droplets of the first curable material comprises inkjet printing the curable material from a first printhead.

3. The printing method of claim 1, wherein the first curable material comprises an ultraviolet (UV) curable ink.

4. The printing method of claim 3, wherein the at least partially curing of the first curable material comprises exposing the first curable material to UV radiation.

5. The printing method of claim 1, wherein the modifying of the under-layer's surface energy comprises exposing the surface to at least one of a flame, a corona, a plasma, or combinations thereof.

6. The printing method of claim 1, wherein the modifying of the under-layer's surface energy is performed before the depositing of the droplets of the second curable material.

7. The printing method of claim 1, further comprising at least partially curing the second curable material to form a color layer over the under-layer, wherein the color layer comprises a third surface energy.

8. The printing method of claim 7, wherein the second curable material comprises an ultraviolet (UV) curable ink.

9. The printing method of claim 8, wherein the at least partially curing of the first curable material comprises exposing the first curable material to UV radiation.

10. The printing method of claim 7, further comprising modifying the color layer's surface energy from the third surface energy to a fourth surface energy.

11. The printing method of claim 7, wherein the modifying of the color layer's surface energy comprises exposing the color layer's surface to at least one of a flame, a corona, a plasma, or combinations thereof.

12. The printing method of claim 8, further comprising depositing droplets of a third curable material on the color layer.

13. The printing method of claim 12, further comprising at least partially curing the third curable material to form an overcoat layer over the color layer.

14. The printing method of claim 12, wherein the UV curable ink comprises a black colorant, a magenta colorant, a cyan colorant, a yellow colorant or combinations thereof.

15. The printing method of claim 1, wherein the first curable material comprises a white ultraviolet (UV) curable ink.

16. The printing method of claim 1, wherein the substrate comprises one or more of a sheet of paper, a cardboard, or a plastic.

17. A printing apparatus, comprising:

a substrate handling and transport system;

at least one jetting nozzle of a first printhead positioned proximate the substrate handling and transport system, and configured for jetting first curable material droplets imagewise onto a substrate;

at least one under-layer curing station for curing the first curable material to form an under-layer on the substrate;

at least one under-layer surface-modification station for modifying the under-layer's surface energy from a first surface energy to a second surface energy; and at least one jetting nozzle of a second printhead positioned proximate the substrate handling and transport system, and configured for jetting second curable material droplets imagewise onto the under-layer.

18. The printing apparatus of claim 17, wherein the under-layer surface-modification station provides at least one of a flame, a corona, a plasma, or combinations thereof to the under-layer surface.

19. The printing apparatus of claim 17, further comprising:

at least one color layer curing station for curing the second curable material to form a color layer over the under-layer; and at least one color-layer surface-modification unit for modifying the under-layer's surface energy from a third surface energy to a fourth surface energy, wherein the at least one color-layer surface-modification unit provides at least one of a flame, a corona, a plasma, or combinations thereof to the color-layer surface.

20. The printing apparatus of claim 19, further comprising:

at least one jetting nozzle of a third printhead positioned proximate the substrate handling and transport system, and configured for jetting third curable material droplets imagewise onto a substrate; and at least one overcoat layer curing station for curing the third curable material to form an overcoat layer over the color layer.

* * * * *